US010937379B2

(12) United States Patent
Li et al.

(10) Patent No.: US 10,937,379 B2
(45) Date of Patent: Mar. 2, 2021

(54) DISPLAY DEVICE AND DRIVING METHOD THEREOF

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yafei Li, Beijing (CN); Bo Gao, Beijing (CN); Xiurong Wang, Beijing (CN); Wei Sun, Beijing (CN); Hao Zhang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 258 days.

(21) Appl. No.: 16/084,833

(22) PCT Filed: Dec. 8, 2017

(86) PCT No.: PCT/CN2017/115290
§ 371 (c)(1),
(2) Date: Sep. 13, 2018

(87) PCT Pub. No.: WO2018/205589
PCT Pub. Date: Nov. 15, 2018

(65) Prior Publication Data

US 2020/0302885 A1 Sep. 24, 2020

(30) Foreign Application Priority Data

May 12, 2017 (CN) ..... 201710335663.2

(51) Int. Cl.
*G09G 3/36* (2006.01)
*G09G 3/34* (2006.01)

(52) U.S. Cl.
CPC ..... *G09G 3/3618* (2013.01); *G09G 3/3406* (2013.01); *G09G 3/3607* (2013.01); *G09G 2310/0291* (2013.01)

(58) Field of Classification Search
CPC ..... G09G 3/3618; G09G 2340/0435
See application file for complete search history.

(56) References Cited

U.S. PATENT DOCUMENTS 5,912,651 A 6/1999 Bitzakidis et al.
2004/0001054 A1* 1/2004 Nitta ..... G09G 3/3648 345/204

(Continued)

FOREIGN PATENT DOCUMENTS

CN 1455382 A 11/2003
CN 101305411 A 11/2008

(Continued)

OTHER PUBLICATIONS

International Search Report of PCT/CN2017/115290 in Chinese, dated Mar. 8, 2018, with English translation.

(Continued)

*Primary Examiner* — Kevin M Nguyen
(74) *Attorney, Agent, or Firm* — Collard & Roe, P.C.

(57) ABSTRACT

A display device and a driving method thereof are disclosed. The display device includes a display panel, a processor and a driver; the driver includes a buffer; time for displaying one frame image includes display time and black insertion time. The driving method of the display device includes: outputting data for displaying one frame image which includes first subdata by the processor, and transmitting the first subdata to the buffer by the processor within the display time; and (Continued)

bufferring the first subdata by the buffer within the display time, and transmitting the first subdata to the display panel by the buffer within the black insertion time.

14 Claims, 4 Drawing Sheets

(56) References Cited

U.S. PATENT DOCUMENTS

| | | | | |
|---|---|---|---|---|
| 2004/0012551 | A1 | 1/2004 | Ishii | |
| 2006/0176261 | A1 | 8/2006 | Nitta et al. | |
| 2007/0147517 | A1* | 6/2007 | Hu | H04N 19/587 375/240.27 |
| 2009/0046104 | A1 | 2/2009 | Boiko | |
| 2010/0020110 | A1 | 1/2010 | Yamato | |
| 2012/0062547 | A1* | 3/2012 | Yamada | G09G 3/344 345/214 |
| 2013/0009974 | A1* | 1/2013 | Nurmi | G09G 3/3406 345/545 |

FOREIGN PATENT DOCUMENTS

| | | | |
|---|---|---|---|
| CN | 101627419 | A | 1/2010 |
| CN | 106920531 | A | 7/2017 |

OTHER PUBLICATIONS

Notice of Transmittal of the International Search Report of PCT/CN2017/115290 in Chinese, dated Mar. 8, 2018.

Written Opinion of the International Searching Authority of PCT/CN2017/115290 in Chinese, dated Mar. 8, 2018 with English translation.

* cited by examiner

Buffer 311

DISPLAY DEVICE AND DRIVING METHOD THEREOF

CROSS-REFERENCE TO RELATED APPLICATIONS

This application is the National Stage of PCT/CN2017/115290 filed on Dec. 8, 2017, which claims priority under 35 U.S.C. § 119 of Chinese Application No. 201710335663.2 filed on May 12, 2017, the disclosure of which is incorporated by reference.

TECHNICAL FIELD

At least one embodiment of the disclosure relates to a display device and a driving method thereof.

BACKGROUND

In a liquid crystal display (LCD) device, in order to solve the streaking problem caused by the liquid crystal response time, black insertion design of backlight can be adopted. The time for displaying one frame image includes display time and black insertion time. Within the black insertion time, the backlight is in the off state, and the refresh of data (pixel refresh and liquid crystal rotation) for displaying one frame image is performed. Within the display time, liquid crystal response is completed, and the backlight is turned on for display.

SUMMARY

At least one embodiment of the disclosure relates to a display device and a driving method thereof, which can increase the data transmission time, reduce the transmission time of the data refresh process within the black insertion time, and hence avoid the risk of display tearing caused by insufficient data transmission time.

At least one embodiment of the disclosure provides a method for driving a display device, wherein the display device includes a display panel, a processor and a driver; the driver includes a buffer; time for displaying one frame image includes display time and black insertion time; and the method comprises: outputting data for displaying one frame image which includes first subdata by the processor, and transmitting the first subdata to the buffer by the processor within the display time; and bufferring the first subdata by the buffer within the display time, and transmitting the first subdata to the display panel by the buffer within the black insertion time.

At least one embodiment of the disclosure provides a display device, comprising: a display panel configured to image display, in which time for displaying one frame image includes display time and black insertion time; a processor configured to output data, in which data for displaying one frame image includes first subdata, and the processor is configured to output the first subdata within the display time; and a driver including a buffer which is configured to receive and buffer the first subdata within the display time and transmit the first subdata to the display panel within the black insertion time.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Unless otherwise specified, the technical terms or scientific terms used in the disclosure have normal meanings understood by those skilled in the art. The words "first", "second" and the like used in the disclosure do not indicate the sequence, the number or the importance but are only used for distinguishing different components. The word "comprise", "include" or the like only indicates that an element or a component before the word contains elements or components listed after the word and equivalents thereof, not excluding other elements or components. The words "connection", "connected" and the like are not limited to physical or mechanical connection but may include electrical connection, either directly or indirectly. The words "on", "beneath", "left", "right" and the like only indicate the relative position relationship which is correspondingly changed when the absolute position of a described object is changed.

Figure 1:
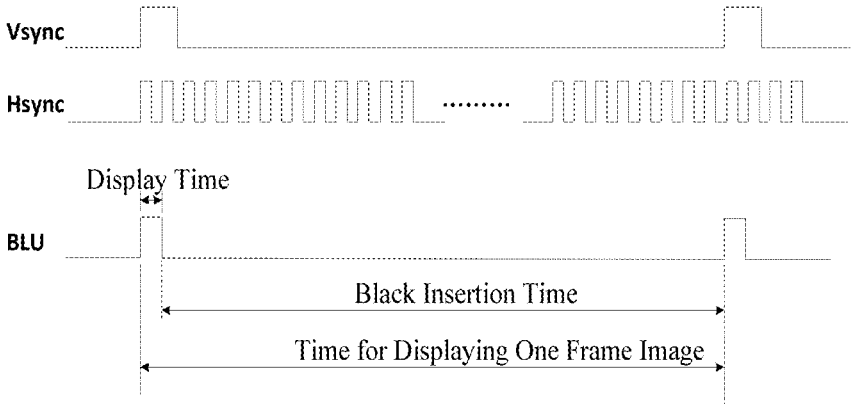
FIG. 1 is a schematic diagram illustrating the time for displaying one frame image, vertical synchronization and horizontal synchronization in one embodiment of the disclosure.

As shown in FIG. 1, in an LCD device, the time for displaying one frame image includes black insertion time and display time; by adoption of the black insertion design of backlight, a backlight source is turned on for display within the display time and is turned off within the black insertion time. That is to say, data refresh (data transmission and pixel charging) is performed within the black insertion time; the transmission of data for displaying one frame image is completed in the data refresh process; pixel charging and liquid crystal deflection are realized through data refresh; and then the display of one frame image can be realized. Within the display time, only the backlight source is turned on for display and data transmission is not performed. When the on time of the backlight source is longer, the data transmission (pixel refresh) time is compressed to be shorter. Thus, the refresh time (transmission time) of data will be affected under ultrahigh resolution, so the risks of display tearing and insufficient charging will be caused. For instance, AR/VR products usually have the above problems. In FIG. 1, Vsync represents frame synchronizing signal and indicates the start of the scanning of the data for displaying one frame image, and one frame image is also an image displayed by the LCD. Hsync represents line synchronizing signal and indicates the start of the scanning of one line.

The time for displaying one frame image includes black insertion time and display time which affect each other. When the black insertion time is longer, the on time of the backlight source is shorter, and the brightness of a module is lower. When the display time is longer, the data refresh (data transmission) time is shorter, and then there are risks of insufficient charging and display tearing.

For instance, when the resolution is fixed, the amount of data required to be transmitted for each frame is fixed. The total amount of data=X (horizontal resolution) x Y (vertical resolution)×24 (bit). When the refresh rate is fixed, the time of each frame is fixed. The total amount of data must be transmitted within the time of one frame, or else, display tearing will occur.

In the general black insertion design of backlight, within the black insertion time, a processor transmits the data for displaying one frame image to a driver, and the driver transmits the data to a display panel, so the data transmission time is long. Thus, the data transmission time will be insufficient, and then the risk of display tearing will occur.

Figure 2:
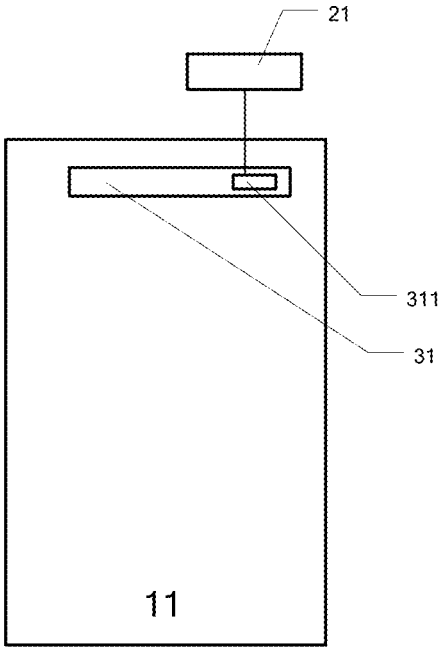
FIG. 2 is a schematic top view of a display device provided by one embodiment of the disclosure.

As illustrated in FIG. 2, at least one embodiment of the disclosure further provides a display device, which comprises a display panel 11, a processor 21 and a driver 31.

The display panel 11 is used for image display. The time for displaying one frame image includes display time and black insertion time (as shown in FIG. 1).

The processor 21 is configured to output data.

Figure 3:
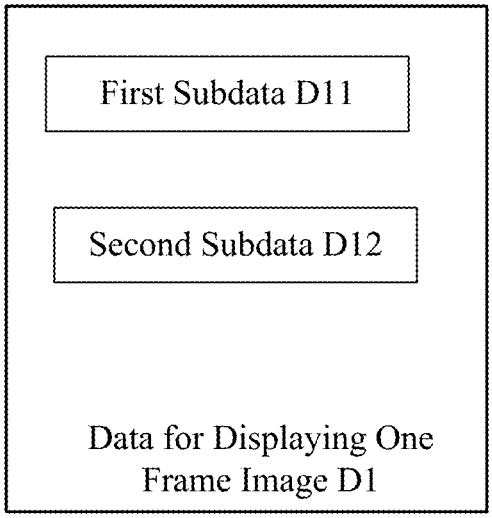
FIG. 3 is a schematic diagram illustrating the division of data for displaying one frame image in the display device provided by one embodiment of the disclosure.

As shown in FIG. 3, data D1 for displaying one frame image includes first subdata D11. The processor 21 is configured to output the first subdata D11 within the display time.

The driver 31 includes a buffer 311 (as shown in FIG. 2). The buffer 311 is configured to receive and buffer the first subdata D11 within the display time and transmit the first subdata D11 to the display panel 11 within the black insertion time.

The display device provided by at least one embodiment of the disclosure can increase the data transmission time by data pre-transmission within the display time (outputting the first subdata D11 within the display time), reduce the transmission time of the data refresh process within the black insertion time, and hence avoid the risk of display tearing caused by insufficient data transmission time. For instance, 1/n data for displaying one frame image may be pre-transmitted within the display time, and then the 1/n data for displaying one frame image is prestored in the buffer. As the speed of transmitting the first subdata D11 from the buffer to the display panel is higher than the speed from the processor to the buffer of the driver, the time of transmitting the first subdata D11 from the processor to the driver is saved. Thus, the transmission time of the data refresh process within the black insertion time can be reduced.

According to the display device provided by one embodiment of the disclosure, the display and the pre-transmission of the first subdata D11 are performed within the display time, and the refresh of the data for displaying one frame image is performed within the black insertion time. Within the black insertion time, pixels perform the transmission of the data D1 from the buffer 311 to the display panel; the data is refreshed; and liquid crystals are deflected. The first subdata D11 in the data D1 is transmitted from the buffer 311 to the display panel.

Figure 4:
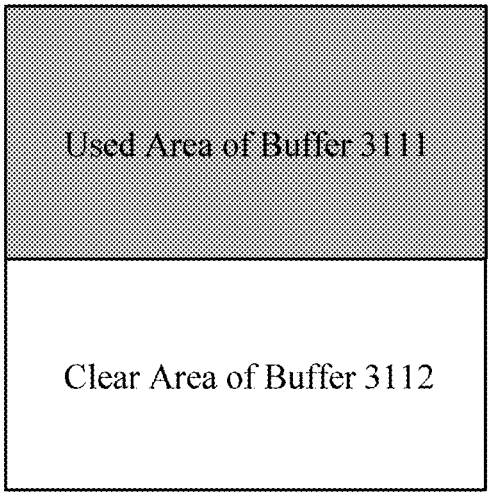
FIG. 4 is a schematic diagram of a buffer in the display device provided by one embodiment of the disclosure.

As shown in FIG. 3, according to the display device provided by one embodiment of the disclosure, the data D1 for displaying one frame image further includes second subdata D12. As shown in FIG. 4, when the first subdata D11 is at least partially transmitted to the display panel 11, a clear area 3112 of the buffer 311 is configured to progressively buffer (fill) the second subdata D12 within the black insertion time, and the buffer 311 is also configured to progressively transmit the buffered data in the buffer 311 to the display panel 11 within the black insertion time. The display device provided by the embodiment saves the time of transmitting the second subdata D12 from the processor to the driver by the read and write of the buffer within the black insertion time, maximally reduces the transmission time required by the data refresh process, avoids insufficient transmission time, and avoids insufficient pixel charging time.

It should be noted that the second subdata D12 may also be directly transmitted to the driver 31 from the processor 21 and then transmitted to the display panel 11 from the driver 31, and is not buffered in the buffer 311. No limitation will be given here in the embodiment of the disclosure. When the second subdata D12 is not buffered in the buffer 311, the first subdata D11 of the buffer 311 is transmitted to the display panel 11 at first, and then the second subdata D12 is transmitted to the driver 31 from the processor 21 and then transmitted to the display panel 11 from the driver 31. This mode does not buffer the data in the buffer 311. Compared with the mode that the second subdata D12 is buffered in the buffer 311, as the time of transmitting the data from the processor 21 to the driver 31 is not saved, the data transmission time within the black insertion time is long.

In the embodiment of the disclosure, the description that the data D1 for displaying one frame image includes the first subdata D11 and the second subdata D12 is for more clear illustration of the pre-transmission and prestorage of the data within the display time.

For instance, as shown in FIG. 4, an area with buffered data in the buffer 311 is a used area 3111 (an area stored with data) of the buffer, and an area in the buffer 311, apart from the used area 3111, is the clear area 3112 (an area not stored with data, an area where data can be filled). As the time for transmitting the data from the processor 21 to the driver 31 is longer than the time for transmitting the data in the buffer 311 of the driver 31 to the display panel 11, within the black insertion time, when the first subdata D11 is at least partially transmitted to the display panel 11, along with the prolonging of the time, there will be more and more clear areas in the buffer 311 until the entire buffer 311 becomes the clear area 3112, and then the refresh of the data for displaying one frame image can be completed.

According to the display device provided by one embodiment of the disclosure, the processor 21 is configured to progressively output the data to the buffer 311 within the time for displaying one frame image, and the buffer 311 is configured to progressively transmit the buffered data to the display panel 11 within the black insertion time. As similar to the case that a reservoir discharges water while injecting water, the processor 31 inputs the data into the buffer 311 on one hand, and the buffer 311 transmits the data to the display panel 11 on the other hand, until all the data in the buffer 311 are transmitted to the display panel 11, and then the transmission of the data for displaying one frame image can be completed (the refresh of the data for displaying one frame image is completed). That is to say, the first subdata D11 is pre-transmitted and prestored into the buffer 311 within the display time; the second subdata D12 is progressively pre-transmitted and prestored into the clear area 3112 of the buffer 311 within the black insertion time; and within the black insertion time, the data stored in the buffer 311 is transmitted to the display panel 11 for the refresh of the data for displaying one frame image.

Figure 5:
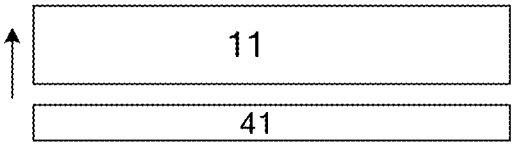
FIG. 5 is a schematic diagram of a display device provided by one embodiment of the disclosure.

As shown in FIG. 5, according to the display device provided by one embodiment of the disclosure, the display device further comprises a backlight source 41. The backlight source 41 is turned on within the display time and turned off within the black insertion time. Light of the backlight source 41 is incident into the display panel 11 and provides a light source for the display panel.

Figure 6:
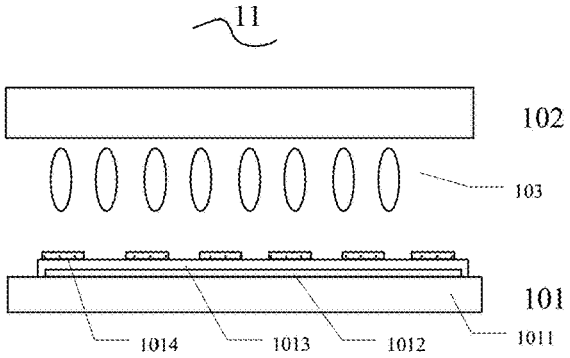
FIG. 6 is a schematic diagram of a display panel in the display device provided by one embodiment of the disclosure.

As shown in FIG. 6, according to the display device provided by one embodiment of the disclosure, the display device comprises an LCD device. For instance, the display panel 11 includes an array substrate 101, an opposed substrate 102 and a liquid crystal layer 103, and the liquid crystal layer 103 is sealed between the array substrate 101 and the opposed substrate 102. The array substrate 101 generally includes a base substrate 1011 and pixel electrodes 1014 and common electrodes 1012 disposed on the base substrate. Liquid crystals in the liquid crystal layer 103 are deflected under the action of electric fields formed by the pixel electrodes 1014 and the common electrodes 1012. Description is given in FIG. 6 by taking an advanced super dimension switching (ADS) mode display panel as an example, but the LCD panel is not limited to this mode. For instance, the common electrodes 1013 may also be disposed on the opposed substrate 102. A color filter (CF) layer may be disposed on the opposed substrate 102 to realize color display. A thin-film transistor (TFT) taken as a switch and connected with each pixel electrode 1014 is not shown in FIG. 6. The pixel electrodes 1014 and the common electrodes 1012 are insulated from each other. An insulating layer 1013 between the pixel electrodes 1014 and the common electrodes 1012 is shown in FIG. 6.

Figure 7:
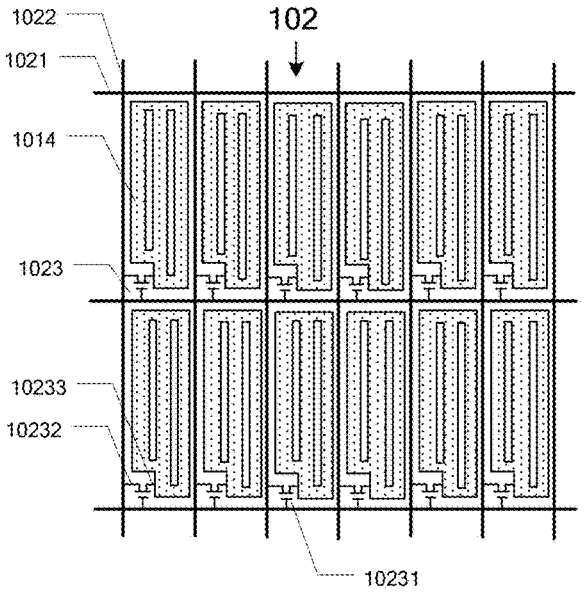
FIG. 7 is a schematic top view of an array substrate in the display device provided by one embodiment of the disclosure.

As shown in FIG. 7, according to the display device provided by one embodiment of the disclosure, a plurality of gate lines 1021 and a plurality of data lines 1022 are disposed on the base substrate 1011 of the array substrate 101; the plurality of gate lines 1021 may be parallel to each other (line direction); the plurality of data lines 1022 may be parallel to each other (column direction); and the plurality of gate lines 1021 and the plurality of data lines 1022 are insulated from each other and intersected with each other, for instance, the plurality of gate lines 1021 and the plurality of data lines 1022 may be perpendicular to each other. An insulating layer may be disposed between the plurality of gate lines 1021 and the plurality of data lines 1022 to insulate the gate lines from the data lines.

As shown in FIG. 7, the array substrate may further include TFTs 1023. The TFT 1023 includes a gate electrode 10231, an active layer (not shown in the figure), a source electrode 10232 and a drain electrode 10233. The source electrode 10232 and the drain electrode 10233 are electrically insulated from the gate electrode 10231; the gate electrode 10231 is electrically insulated from the active layer; and the source electrode 10232 and the drain electrode 10233 may be respectively electrically connected with the active layer. The source electrode 10232 and the drain electrode 10233 are electrically connected when the TFT is switched on and insulated from each other when the TFT is switched off.

As shown in FIG. 7, for instance, the gate electrode 10231 is electrically connected with the gate line 1021; the source electrode 10232 is electrically connected with the data line 1022; and the drain electrode 10233 is electrically connected with the pixel electrode 1024. The gate line 1021 is configured to input an on or off signal into the gate electrode 10231 of the TFT 1023, so as to switch on or off the TFT 1023. The data line 1022 is configured to input voltage data (grayscale voltage, driving voltage) into the pixel electrode 1024 through the TFT 1023 in the on state, so that subpixels 102 can display different grayscales (the grayscale voltage runs through the source electrode 10232, the active layer and the drain electrode 10233 and arrives at the pixel electrode 1024). The plurality of gate lines 1021 and the plurality of data lines 1022 may be intersected with each other to define a plurality of subpixels 102, which is not limited thereto. After the grayscale voltage is inputted into the subpixel 102, an electrical field may be formed between the pixel electrode 1014 and the common electrode 1012, and a storage capacitor is formed to support image display within the time of one frame. Each pixel electrode 1014 and the TFT connected with the pixel electrode may be independently controlled. For instance, the display of one frame image can be realized by progressive scanning, which is not limited thereto. For instance, the grayscale voltage of this line of subpixels may be written when each line of subpixels are switched on, which is not limited thereto.

For instance, one subpixel 102 generally includes one gate line 1021, one data line 1022, one TFT 1023 and one pixel electrode 1014. The data includes grayscale voltage data.

Figure 8:
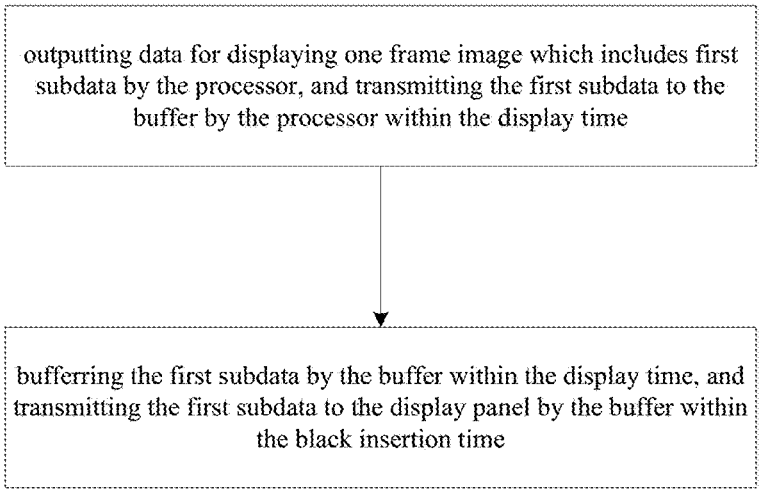
FIG. 8 is a schematic diagram of a method for driving a display device provided by one embodiment of the disclosure.

As illustrated in FIG. 8, at least one embodiment of the disclosure provides a method for driving a display device. The display device includes a display panel 11, a processor 21 and a driver 31. The driver 31 includes a buffer 311. The time for displaying one frame image includes display time and black insertion time. The method comprises: outputting data D1 for displaying one frame image the processor 21 by the processor 21, in which the data D1 for displaying one frame image includes first subdata D11; transmitting the first subdata D11 to the buffer 311 by the processor 21 within the display time; buffering the first subdata D11 by the buffer 311 within the display time; and transmitting the first subdata D11 to the display panel 11 by the buffer 311 within the black insertion time.

The method for driving the display device, provided by at least one embodiment of the disclosure, can increase the data transmission time by data pre-transmission within the display time, reduce the transmission time of the data refresh process within the black insertion time, and hence avoid the risk of display tearing caused by insufficient data transmission time. The embodiment can save the time of transmitting the first subdata D11 from the processor to the driver and hence can reduce the transmission time of the data refresh process within the black insertion time. The buffer 311 is, for instance, an RAM. For instance, the driver is a driver integrated circuit (IC), which is not limited thereto.

According to the method for driving the display device, provided by one embodiment of the disclosure, the display and the pre-transmission of the first subdata D11 are performed within the display time, and the refresh of the data D1 for displaying one frame image is performed within the black insertion time.

According to the method for driving the display device, provided by one embodiment of the disclosure, the data D1 for displaying one frame image further includes second subdata D12. After the first subdata D11 is at least partially transmitted to the display panel 11, the clear area 3112 of the buffer 311 progressively buffers the second subdata D12 within the black insertion time, and meanwhile, the buffer 311 progressively transmits the buffered data in the buffer 311 to the display panel 11 within the black insertion time.

According to the method for driving the display device, provided by one embodiment of the disclosure, the processor 21 progressively outputs the data to the buffer 311 within the time for displaying one frame image; and the buffer 311 progressively transmits the buffered data to the display panel 11 within the black insertion time.

According to the method for driving the display device, provided by one embodiment of the disclosure, after the first subdata D11 is transmitted to the display panel 11 from the buffer 3111, the second subdata D12 is transmitted to the driver 31 from the processor 21 and then transmitted to the display panel 11 from the driver 31. In this mode, the second subdata D12 is not buffered in the buffer 311. Compared with the mode that the second subdata D12 is buffered in the buffer 311, as the time of transmitting the data from the processor 21 to the driver 31 is not saved, the data transmission time within the black insertion time is long.

According to the method for driving the display device, provided by one embodiment of the disclosure, within the display for displaying one frame image, the display time is ahead of the black insertion time.

According to the method for driving the display device, provided by one embodiment of the disclosure, the data includes grayscale voltage data.

According to the method for driving the display device, provided by one embodiment of the disclosure, the display device further includes a backlight source 41. The backlight source 41 is turned on within the display time and turned off within the black insertion time.

The time of reading the data from the buffer 311 (e.g., a dynamic random access memory (DRAM)) (the buffer 311 transmits the data to the display panel 111) and the time of data storage (the time of receiving and storing the data transmitted by the processor) can be synchronized (dynamic read and write must be synchronized). If the time is not synchronized (the writing speed of the buffer 311 is insufficient), display tearing will occur.

According to the method for driving the display device, provided by one embodiment of the disclosure, the second subdata D12 is buffered in the buffer 311. If the refresh frame rate (the refreshing frequency within unit time) is f, the buffer 311 buffering data for displaying 1/(f×n) image within the display time, the display time being x, the black insertion time being (1/f)−x, in order to avoid display tearing caused by insufficient writing speed of the buffer 311 and solve the problem of data read and write synchronization of the buffer 311, $x<1/[f\times(n+1)]$, in which n is a positive integer, and moreover, for instance, n is an integer greater than or equal to 2. If n=3 and f=90 Hz, x=2.78 ms, so the display time x almost occupies 25% of the time for displaying one frame image (1/f, 11.1 ms).

The derivation process of the display time x may be as follows.

Figure 9:
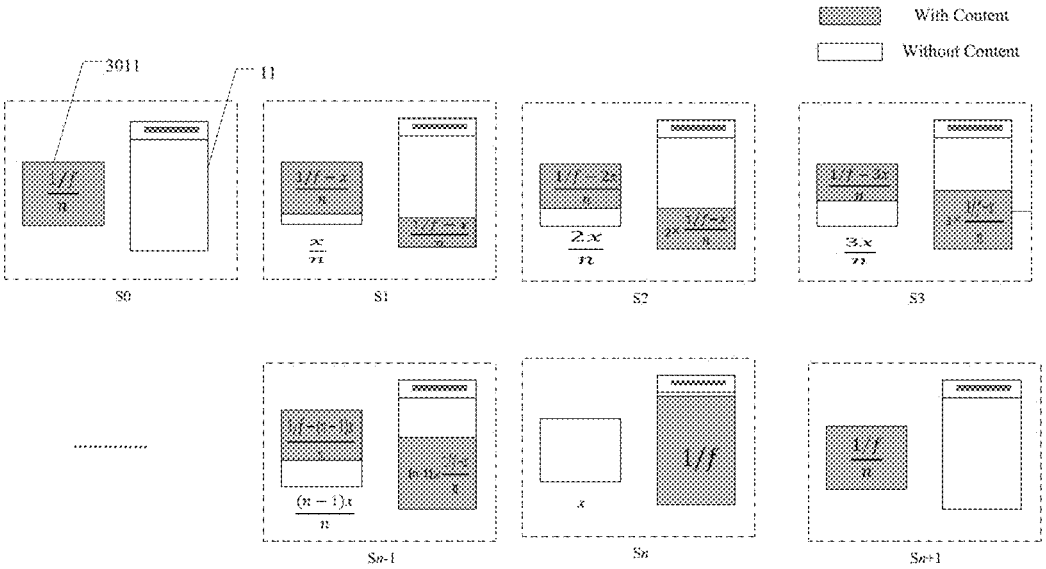
FIG. 9 is a schematic diagram of the method for driving the display device provided by one embodiment of the disclosure.

As shown in FIG. 9, states from state 0 (S0) to state n+1 (Sn+1) are shown, and the time for displaying one frame image may correspond to the state 0 (S0) to the state n (Sn). The state 0 (S0) may correspond to the initial state or the display state of the previous frame image. S0 and Sn+1 correspond to the display time in the time for displaying one frame image. The state 1 to the state n (S1-Sn) correspond to the black insertion time in the time for displaying one frame image.

The amount of data transmitted to the display panel 11 by each state buffer 311 is the data for displaying [(1/f)−x]/n image. Supposing that the black insertion time is divided into n states, in S1-Sn, each state corresponds to the time for displaying the [(1/f)−x]/n image of the display panel 11, and the data of 1/(f×n) may be stored by adding 1/n buffer for the driver.

As shown in FIG. 9, in the state 0 (S0), the buffer 311 buffers the data for displaying the 1/(f×n) image within the display time; and in the states from 1 (S1) to n (Sn), the buffer 311 progressively transmits the buffered data to the display panel 11. Thus, as the speed of transmitting the data from the processor 21 to the buffer 311 is lower than the speed of transmitting the data from the buffer 311 to the display panel 11, the buffer 311 is gradually unoccupied, and the second subdata D12 may be gradually filled into the clear area 3112 of the buffer 311. The buffer 311 is gradually unoccupied and the entire buffer 311 becomes the clear area in the state Sn. During Sn, the remaining part in the data for displaying one frame image is buffered in the buffer 311, and meanwhile, the buffered data is transmitted to the display panel. At the end of Sn, the transmission of the data for displaying one frame image (the data for displaying one frame image is transmitted to the display panel 11) is just completed.

Supposing that the writing speed of the buffer 311 just satisfies the display requirement, the following condition must be satisfied: the time for buffering the data for displaying one frame image 1/f is matched with the time for transmitting one frame image (data refresh time) (1/f−x).

At the end of the state Sn+1, the time x must be adopted to fill the unoccupied buffer (1/n RAM) (the clear area 3112). Thus, in the process of data read and write in the buffer in the states S1-Sn, each state exactly has x/n spare time. Analogically, in Sn, the data for displaying one frame image is also transmitted to the display panel 11 for display when the data for displaying one frame image is just prestored, and the unoccupied buffer is used for prestoring data of the next frame.

The filling time of unoccupied data of each state is less than the refresh time of transmitting the prestored data to the display panel 11, otherwise, data transmission cannot keep up with refresh, and then display tearing will occur.

By comparing the maximum x of the filling time of the unoccupied data in the n states with the refresh time [(1/f)−x]/n of transmitting the data to the display panel 11 by the buffer 311, $x<[(1/f)-x]/n$ is required, so the relationship between n and x can be obtained from $x<1/[f\times(n+1)]$.

The description of the flow will be given below with reference to FIG. 9.

(1) In S0, the buffer 311 prestores the 1/n data for displaying one frame image (the first subdata D11 is prestored in the buffer and may correspond to the time for displaying the 1/(f×n) image), in the beginning of the black insertion time, the driver may directly read the data from the buffer 311 to the display panel 11, so the time for transmitting the data from the processor 21 to the driver 31 can be saved.

(2) In S1-Sn, the backlight source is in the off state, and at this point, the time is the refresh and charging time (data refresh time) of the LCD. The driver 31 reads the data from the buffer 311 to the display panel 11 on one hand, and the processor 21 transmits the data to the buffer 311 of the driver 31 for data prestorage on the other hand. At the end of Sn, the refresh of the data for displaying one frame image is completed, and at this point, the buffer 311 is empty.

(3) In Sn+1, the backlight source is turned on for display. Within the display time, in the display process, the processor 21 transmits the data (the first subdata D11) to the buffer 311 for prestorage, being ready for the display of the next frame.

The method for driving the display device, provided by one embodiment of the disclosure, can perform data pre-transmission within the display time, namely adopting the display time for data prestorage, which saves the data transmission time from the processor to the driver, can adopt this part of time for data transmission, and hence avoids the problem of display tearing caused by insufficient data transmission time.

In the embodiment of the disclosure, same or similar parts of the display device and the driving method may refer to each other. No further description will be given here.

The following points should be noted:

(1) Unless other defined, the same reference number represents the same meaning in the embodiments and the drawings of the disclosure.

(2) Only the structures relevant to the embodiments of the present invention are involved in the accompanying drawings of the embodiments of the present invention, and other structures may refer to the normal design.

(3) For clarity, the thickness of layers or areas in the accompanying drawings of the embodiments of the present invention is enlarged. It should be understood that when an element such as a layer, a film, an area or a substrate is referred to be disposed "on" or "beneath" another element, the element may be "directly" disposed "on" or "beneath" another element, or an intermediate element may be provided.

(4) The embodiments of the present invention and the characteristics in the embodiments may be mutually combined without conflict.

The foregoing is only the preferred embodiments of the present invention and not intended to limit the scope of protection of the present invention. Any change or replacement that may be easily thought of by those skilled in the art within the technical scope disclosed by the present invention shall fall within the scope of protection of the present invention. Therefore, the scope of protection of the present invention shall be defined by the appended claims.

The invention claimed is:

1. A method for driving a display device, wherein the display device includes a display panel, a processor and a driver; the driver includes a buffer; time for displaying one frame image includes display time and black insertion time; and the method comprises:

outputting data for displaying one frame image which includes first subdata by the processor, and transmitting the first subdata to the buffer by the processor within the display time; and buffering the first subdata by the buffer within the display time, and transmitting the first subdata to the display panel by the buffer within the black insertion time, wherein refresh of data for displaying one frame image is performed within the black insertion time, and a time of reading data from the buffer and a time of data storage to the buffer are synchronized within the black insertion time.

2. The method for driving the display device according to claim 1, wherein displaying and pre-transmission of the first subdata are performed within the display time.

3. The method for driving the display device according to claim 1, wherein the data for displaying one frame image further includes second subdata; after the first subdata is at least partially transmitted to the display panel, the second subdata is progressively buffered in a clear area of the buffer within the black insertion time; and meanwhile, the buffer progressively transmits the buffered data in the buffer to the display panel within the black insertion time.

4. The method for driving the display device according to claim 1, wherein the processor progressively outputs the data to the buffer within the time for displaying one frame image; and the buffer progressively transmits the buffered data to the display panel within the black insertion time.

5. The method for driving the display device according to claim 1, wherein within the time for displaying one frame image, the display time is ahead of the black insertion time.

6. The method for driving the display device according to claim 1, wherein a refresh frame rate is 1; the buffer buffers data for displaying $1/(f\times n)$ image; the display time is x; and then $x<1/[f\times(n+1)]$, in which n is a positive integer.

7. The method for driving the display device according to claim 1, wherein the data includes grayscale voltage data.

8. The method for driving the display device according to claim 1, wherein the display device further includes a backlight source; and the backlight source is turned on within the display time and turned off within the black insertion time.

9. A display device, comprising:

a display panel configured to image display, in which time for displaying one frame image includes display time and black insertion time;

a processor configured to output data, in which data for displaying one frame image includes first subdata; and the processor is configured to output the first subdata within the display time; and a driver including a buffer which is configured to receive and buffer the first subdata within the display time and transmit the first subdata to the display panel within the black insertion time, wherein refresh of data for displaying one frame image is performed within the black insertion time, and a time of reading data from the buffer and a time of data storage to the buffer are synchronized within the black insertion time.

10. The display device according to claim 9, wherein displaying and pre-transmission of the first subdata are performed within the display time.

11. The display device according to claim 9, wherein the data for displaying one frame image further includes second subdata; after the first subdata is at least partially transmitted to the display panel, a clear area of the buffer area is configured to progressively buffer the second subdata within the black insertion time; and the buffer is further configured to progressively transmit the buffered data in the buffer to the display panel within the black insertion time.

12. The display device according to claim 9, wherein the processor is configured to progressively output the data to the buffer within the time for displaying one frame image; and the buffer is configured to progressively transmit the buffered data to the display panel within the black insertion time.

13. The display device according to claim 9, wherein the display device further includes a backlight source; and the backlight source is turned on within the display time and turned off within the black insertion time.

14. The display device according to claim 9, wherein the display device includes a liquid crystal display (LCD) device.

* * * * *